US007798051B2

(12) United States Patent
Stark et al.

(10) Patent No.: US 7,798,051 B2
(45) Date of Patent: Sep. 21, 2010

(54) ARRANGEMENT FOR ELECTRICAL ENERGY TRANSMISSION IN A GUN

(75) Inventors: Ola Stark, Karlskoga (SE); Stig Vitén, Karlskoga (SE); Lennart Gustavsson, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 95 days.

(21) Appl. No.: 11/913,398

(22) PCT Filed: May 2, 2006

(86) PCT No.: PCT/SE2006/000529

§ 371 (c)(1),
(2), (4) Date: Jun. 16, 2008

(87) PCT Pub. No.: WO2006/118531

PCT Pub. Date: Nov. 9, 2006

(65) Prior Publication Data

US 2009/0205484 A1 Aug. 20, 2009

(30) Foreign Application Priority Data

May 3, 2005 (SE) ..... 0501019

(51) Int. Cl.
*F41A 19/69* (2006.01)

(52) U.S. Cl. ..... 89/135; 42/84; 102/472

(58) Field of Classification Search ..... 42/84; 89/135, 28.05; 102/472
See application file for complete search history.

(56) References Cited

U.S. PATENT DOCUMENTS

| | | | | |
|---|---|---|---|---|
| 3,714,728 | A * | 2/1973 | Perkins et al. | 42/84 |
| 3,748,770 | A * | 7/1973 | Mitchell | 42/84 |
| 4,641,450 | A | 2/1987 | Moll et al. | |
| 4,702,027 | A * | 10/1987 | Stanley | 42/76.02 |
| 4,913,029 | A * | 4/1990 | Tidman et al. | 89/8 |
| 5,074,189 | A * | 12/1991 | Kurtz | 89/135 |
| 5,329,840 | A * | 7/1994 | Corney | 89/135 |
| 5,581,928 | A | 12/1996 | Krumm et al. | |
| 5,935,351 | A * | 8/1999 | Sherman et al. | 148/519 |
| 2003/0032339 | A1 * | 2/2003 | Bell et al. | 439/736 |

FOREIGN PATENT DOCUMENTS

| | | | |
|---|---|---|---|
| DE | 19629517 | A1 | 1/1998 |
| GB | 2016361 | A | 9/1979 |
| WO | WO-2004015359 | A1 | 2/2004 |

* cited by examiner

*Primary Examiner*—Stephen M Johnson
(74) *Attorney, Agent, or Firm*—Connolly Bove Lodge & Hutz LLP

(57) ABSTRACT

An electrical energy-insulating, preferably ceramic, insert (15) which is fitted in a barrel (2) is adapted in order to prevent electrical energy transmission (16) from an electric igniter (3) to a barrel body on firing of an ammunition unit (11) which can be initiated with the electric igniter (3). The insert is arranged in a position for firing of the ammunition unit. By means of the invention, a simple solution is obtained to the problem of electrical energy transmission by virtue of the fact that other measures do not have to be taken, for example the cases of the ammunition units do not have to be adapted by complicated and cost-increasing measures.

18 Claims, 4 Drawing Sheets

ARRANGEMENT FOR ELECTRICAL ENERGY TRANSMISSION IN A GUN

RELATED APPLICATIONS

This application is a national stage application (under 35 U.S.C. §371) of PCT/SE2006/000529 filed May 2, 2006, which claims benefit of Swedish application 0501019-4 filed May 3, 2005, disclosure of which is incorporated herein by reference.

TECHNICAL FIELD

The present invention relates to an arrangement for preventing electrical energy transmission from an electric igniter to a barrel body on firing of an ammunition unit which can be initiated with the electric igniter when the igniter is activated with electrical energy.

PROBLEM AND BACKGROUND OF THE INVENTION

A need exists for it to be possible to bring about the said prevention in a technically simple and economically advantageous way. One way of approaching the problem is to arrange the cases of the ammunition units in such a way that they prevent electrical energy transmission, but this is not an entirely advantageous approach as it complicates the construction of the ammunition unit and moreover makes it more expensive. Furthermore, such insulated cases are easy to damage during handling and are difficult to manufacture. The present invention aims to solve, or at least considerably reduce, the said problem of undesirable electricity transmission and proposes inter alia that the barrel is to be made in such a way on its inner surface which lies opposite the ammunition case in the firing position of the ammunition unit that the ammunition unit can have a conventional design, that is to say the ammunition types existing today for the weapon concerned can be fired without difficulty, and in particular without the barrel or the rest of the body of the weapon becoming live when firing takes place.

PRIOR ART

Electric igniters for electric firing of various types of ammunition intended for electrothermal (ET) and electrothermochemical (ETC) weapons are known. Briefly, it can be said that an ET/ETC weapon consists of an essentially powder-gas-driven weapon which is fired by means of an electric ignition and in which weapon the projectile of the ammunition unit is possibly also to some extent propelled along the barrel or corresponding acceleration part of the weapon by means of an applied electric voltage. Problems of undesirable electrical energy transmission can therefore arise both when firing of the weapon takes place and during the said electric propulsion of the projectile. It is previously known to make use of ceramic layers or inserts on the inside of the barrel and in various positions along the longitudinal direction of the barrel but for entirely different purposes and problems from preventing undesirable electrical energy transmission to parts of the weapon.

Accordingly, reference may be made inter alia to American patent specifications U.S. Pat. Nos. 4,957 035, 5,546,844 and 5,581,928, which propose the use of ceramic inserts in a different way from in the present invention.

OBJECT AND FEATURES OF THE INVENTION

In accordance with the invention, it is to be possible inter alia for a ceramic layer or a ceramic unit to be used for the purpose of preventing current being conducted. It can mainly be considered characteristic of an arrangement according to the invention that the barrel is in a position for firing of the ammunition unit provided with an internally located electrically insulating material, preferably in the form of a ceramic insert, which prevents the said electrical energy transmission.

According to other aspects of an arrangement according to the invention:

- the insert is arranged firmly shrunk into the barrel;
- the insert is clamped in with clamping of 300 MPa-1000 MPa, preferably 500 MPa-700 MPa;
- the insert is arranged firmly bonded into the barrel;
- the insert is arranged firmly screwed into the barrel;
- the insert comprises one or more ceramic material(s), preferably made from zirconium dioxide, aluminium oxide or silicon nitride or the like;
- the insert comprises a fibre-reinforced polymer, such as a glass-fibre-reinforced plastic;
- the insert has a straight outer surface and an inner surface which follows the outer surface of an ammunition case;
- the insert is adapted to prevent energy transmission even at high voltage values, for example voltage values of 10-12 kV, for example 11 kV;
- the insert is adapted in order to make firing of an ammunition unit of conventional construction possible without special reinforcement or special material selection in the ammunition case;
- the insert has an average thickness of 5-15 mm, preferably approximately 10 mm, depending on the calibre of the barrel;
- the insert is arranged in the barrel of an ET/ETC weapon.

In a first preferred embodiment, see FIG. 1, the insert is shrunk firmly into the barrel and is clamped with high clamping pressure, for example with clamping pressure of 300 MPa-1000 MPa, preferably 500 MPa-700 MPa. In a second preferred embodiment, see FIG. 2, the insert is externally threaded over the entirety or (not shown) over a given part of its outer surface and the barrel is internally threaded over a corresponding surface, by virtue of which the insert is screwed firmly inside the barrel during assembly. In a third preferred embodiment, see FIG. 3, the insert is adapted to be bonded firmly inside the barrel. The insert can be made from a number of cermets, for example titanium oxide, aluminium oxide or silicon nitride, and is preferably selected with average thicknesses of 5-15 mm, preferably approximately 10 mm. The contacts and outer tube of the electric igniter are connected to the different potentials of an energy source so that the electric igniter is heated in the desired way when energy is applied. High energy transmissions are used in this connection and it may be mentioned that voltage values of 10-12 kV, for example 11 kV, are used today and that values of approximately 2-20 kV are also being tested. The majority of this voltage is converted into heat generation which ignites a propellent charge, suitably a powder charge, in the case of the ammunition unit, into which the electric igniter is introduced. Further developments of the inventive idea emerge from the following subclaims.

LIST OF FIGURES

A for the present proposed embodiment of an arrangement which has the features which are significant for the invention is to be described below with simultaneous reference to accompanying drawings in which FIG. 1 shows diagrammatically in longitudinal section parts of a barrel, comprising a firmly shrunk insert according to a first embodiment of the invention, in which barrel an ammunition unit with a cartridge case is located in the firing position of the ammunition unit and an electric igniter is introduced into the powder or corresponding propellent charge in the cartridge case of the ammunition unit;

DETAILED DESCRIPTION OF EMBODIMENTS

Figure 1:
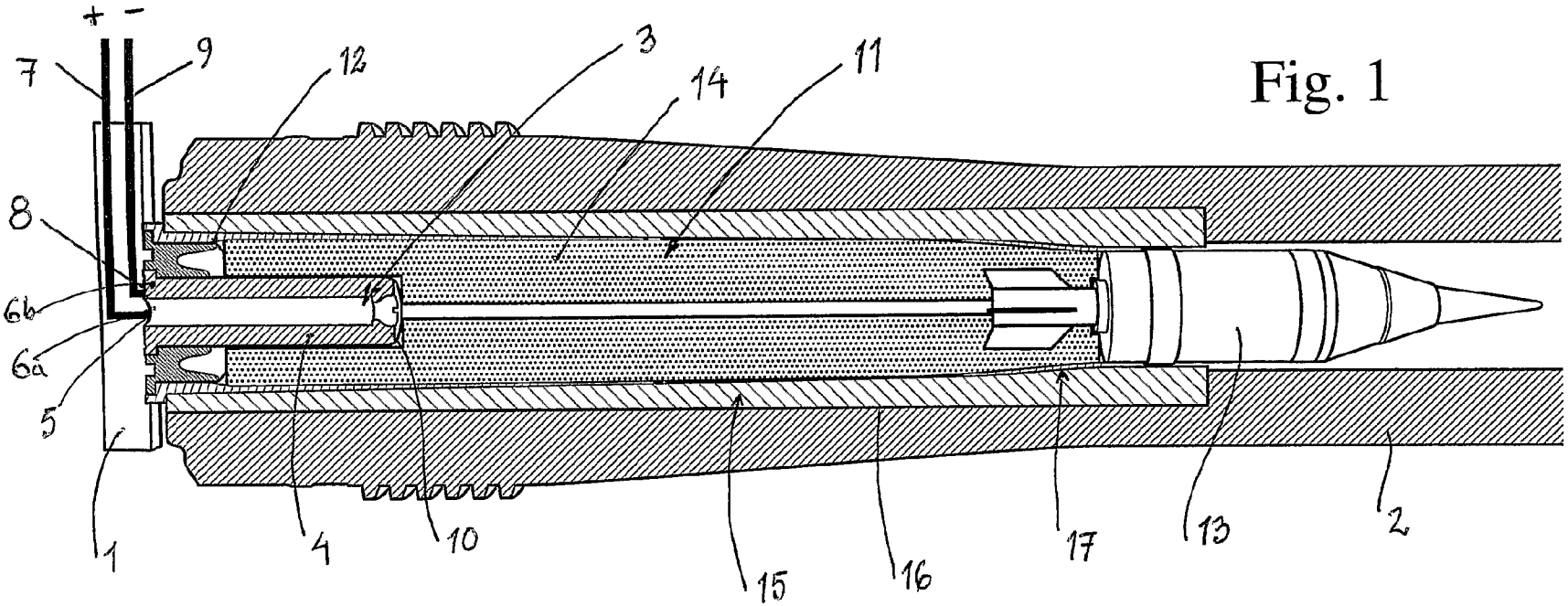

According to FIG. 1, the breech block of a gun is shown symbolically by 1. Connected to the breech block 1 is a barrel 2, the connection of which to the breech block 1 has been shown symbolically. An electric igniter is shown diagrammatically by 3, and the electrically conducting outer tube of the electric igniter 3 is indicated by 4. In the embodiment shown of the electric igniter 3, the igniter 3 is arranged in an electric circuit comprising a first contact 5 arranged centrally at the inner, that is rear, end 6*a* of the electric igniter 3. The said first contact 5 is connected to one current pole of an electric energy source (not shown further), for example its anode, via a first electric conductor 7, the anode being indicated by a plus sign (+). At its inner end 6*b*, the outer tube 4 of the electric igniter 3 is connected to the opposite current pole of the energy source, in this case then its cathode, which is indicated symbolically by a minus sign (−), via a second contact 8 and a second conductor 9. When the first and second contacts 5, 8 are activated, that is when the weapon concerned is fired, a current will flow from the anode (+) of the energy source to the first contact 5 and on to the outer tube 4 at its free end 10, from where the current is conducted on towards the inner end 6*b* of the outer tube 4. At the said end 6*b*, the second contact 8 leads back to the cathode (−) of the energy source via the second conductor 9, which results in a closed electric circuit. The energy source is suitably of such a kind that it can provide a voltage U of 10-12 kV, preferably approximately 11 kV (but see above).

Figure 4:
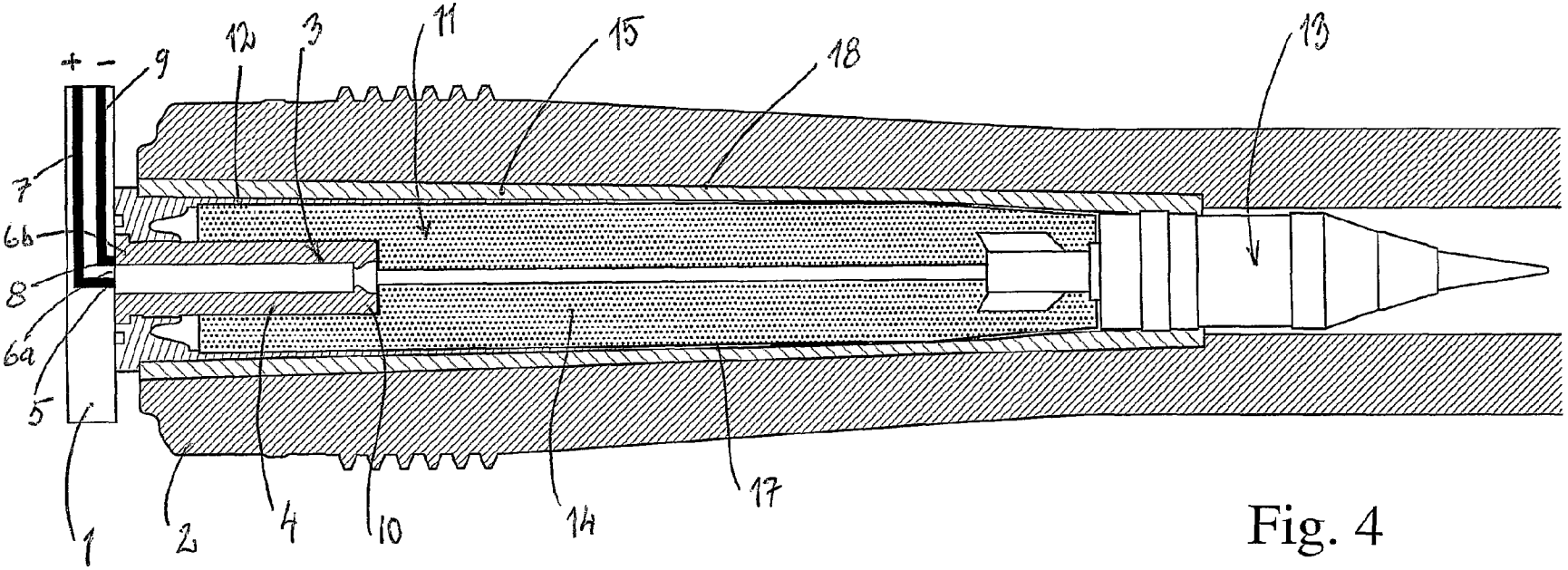
FIG. 4 shows diagrammatically in longitudinal section parts of a barrel comprising an externally conically shaped insert according to a fourth embodiment of the invention.

It is important that electrical energy is prevented from being conducted from the electric igniter 3 to the body of the barrel 2 and thus the body of the gun. Such transmission can harm surrounding equipment and personnel. For firing of the ammunition unit 11 in question, firing contact is initiated in the weapon system. This contact has not been shown in the figures but is previously well known. The initiation results in the voltage of the energy source being connected. The voltage drop of the resistance caused by the electric igniter 3 is considerable when the said connection takes place, which results in considerable heat energy being generated. In accordance with FIG. 1, the electric igniter 3 has been fitted or partly introduced into the case 12 of an ammunition unit 11. The ammunition unit 11, for example a round, a cartridge or a heavier shell etc., is introduced into its firing position in the barrel 2. In the example shown, the ammunition unit 11 comprises the said case which has been indicated by 12 and a projectile 13 assigned to the front part of the case 12. In the embodiment shown, the projectile 13 consists of a finned shell part. The case 12 contains a propellent charge 14, which can consist of powder, for example. When the said energy development takes place, the propellent charge 14 is ignited, the shell part 13 being acted on via the propellent charge gases formed for its discharge from the barrel 2. In order to prevent the said electrical energy transmission from the electric igniter 3 to the body of the barrel 2 when firing takes place, the barrel 2 is provided with an inner insert 15 made of electrically non-conductive material, preferably a ceramic material, in and along the firing position for the said case 12. Materials other than ceramic materials are therefore also conceivable provided they meet the requirements for the necessary electrical insulation and have suitable resistance to the wear and the heat generation which occur during use of the weapon; for example, an insert made of suitable fibre-reinforced polymer, for example glass-fibre-reinforced plastic, also falls within the inventive idea. In this connection, the said plastic insert comprises one or more plies (composite) of polymer of thermosetting plastic or thermoplastic type reinforced with suitable fibrous material in order to meet the requirements for heat resistance and insulation capacity. The insert 15 surrounds and extends over the entire length of the case 12 and past the case 12 to part way in over the shell part 13. The ceramic insert 15 therefore constitutes insulation against the said electrical energy transmission between the electric igniter 3 and the inside of the barrel 2 via the case 12. In the embodiment shown, the insert 15 is made from a cermet material, such as zirconium dioxide, aluminium oxide or silicon nitride or the like, for example, and can have an average thickness t in accordance with the above of 5-15 mm, preferably approximately 10 mm. The insert 15 in the embodiment shown in FIG. 1 has a straight cylindrical outer surface 16, that is to say the outer periphery of the insert 15 is constant along the extent of the insert 15, and an internally conical inner surface 17 which follows the outer design of the case 12. In other embodiments, the outer surface of the insert can comprise a completely conical outer surface 18, see FIG. 4, or comprise both cylindrical and conical parts (not shown).

Figure 2:
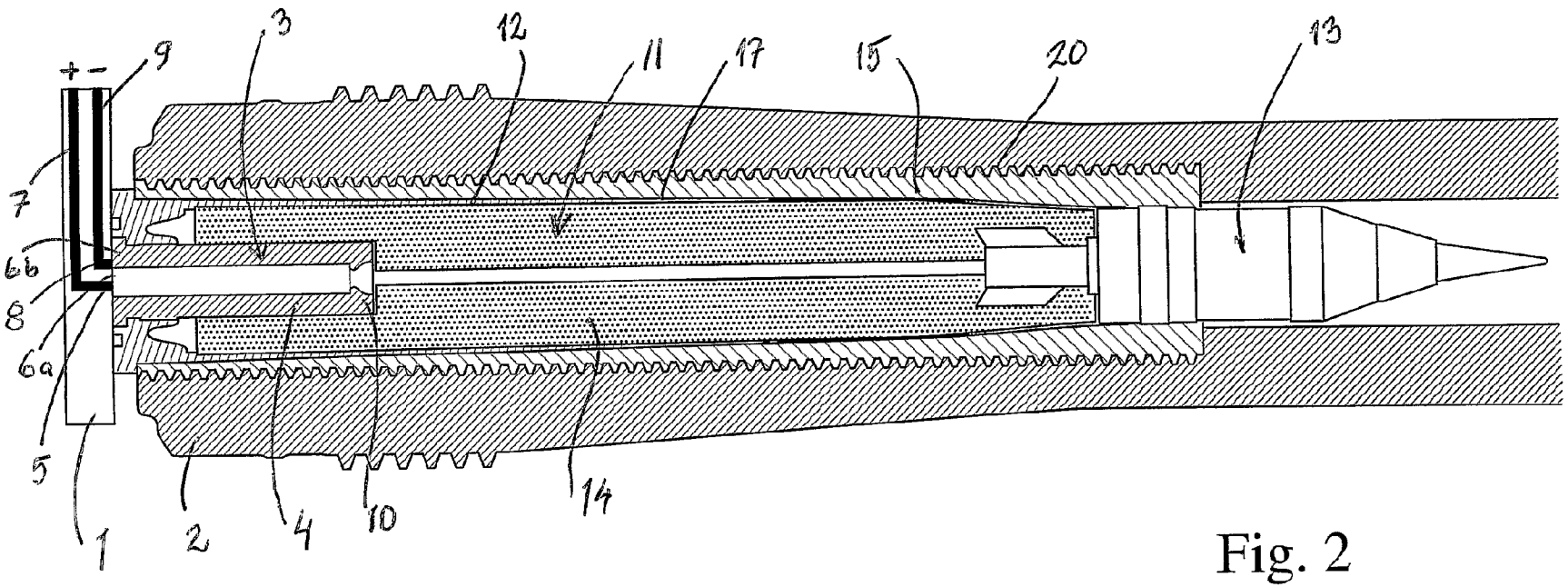
FIG. 2 shows diagrammatically in longitudinal section parts of a barrel comprising an externally threaded insert according to a second embodiment of the invention.
Figure 3:
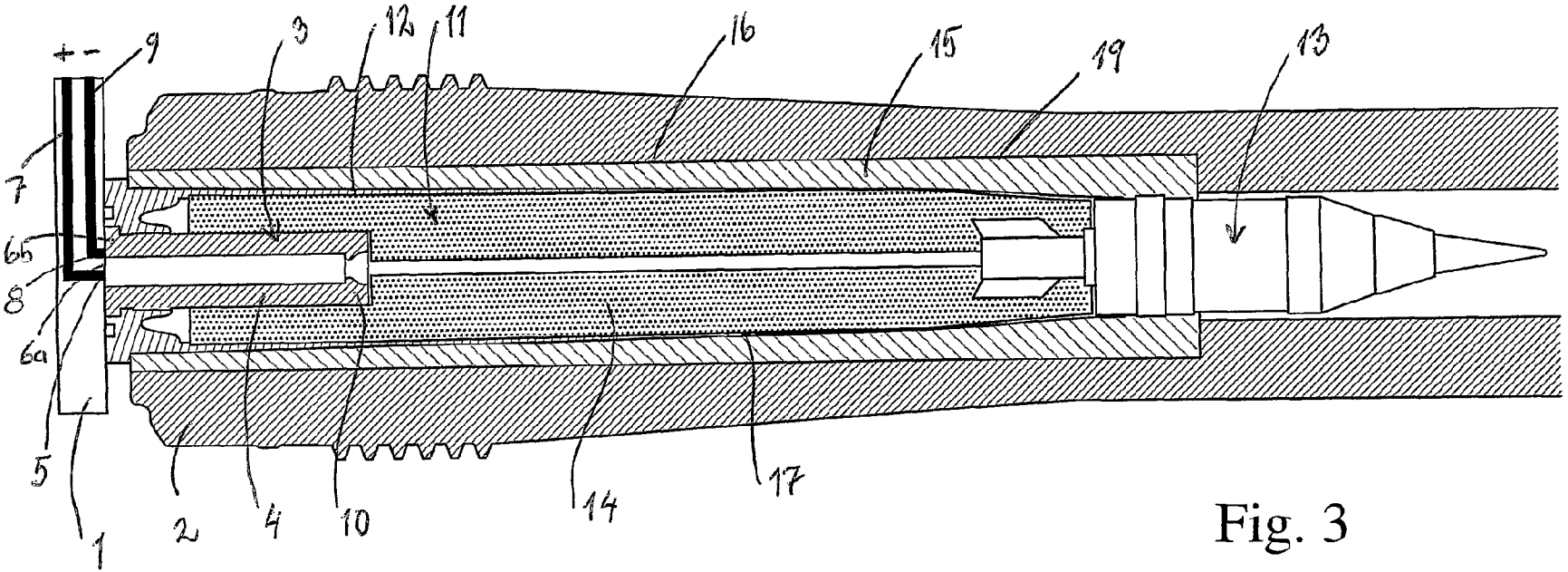
FIG. 3 shows diagrammatically in longitudinal section parts of a barrel comprising a firmly bonded insert according to a third embodiment of the invention.

The said outer design of the case depends on which ammunition unit is intended to be fired in the weapon concerned, and the inner surface of the insert can consequently be adapted to follow, for example, a completely cylindrical case or a case comprising different combinations of cylindrical and conical parts or other outer parts or shapes which are determined by the ammunition type used in the particular case. The general construction of the barrel 2 and the construction of the breech 1 are previously well known and will not be described in greater detail here. However, it is clear that the barrel 2 is internally adapted in order to receive the insert 15 concerned for the ammunition type in question. The barrel 2 therefore comprises a hollow corresponding to the volume and outer shape of the insert, and the hollow of the barrel 2 is also adapted to the assembly method concerned, that is to say whether, see above, the insert is shrunk firmly, screwed firmly 20, see FIG. 2, or bonded firmly 19, see FIG. 3, to the barrel 2. The insert 15 is also adapted to be resistant to the heat energy development which takes place when the propellent charge 14 is activated.

ALTERNATIVE EMBODIMENTS

The invention is not limited to the embodiment described above as an example but can undergo modifications within the scope of the patent claims below and the inventive idea.

It is clear that the number, the size, the material and the shape of the elements and components included in the arrangement, for example the energy source, its voltage, the clamping pressure, the thickness and shape of the insert, are adapted to the barrel, the ammunition unit and the weapon type etc. in the particular case.

The invention claimed is:

1. An arrangement for preventing electrical energy transmission from an electric igniter to a barrel body on firing of an ammunition unit which can be initiated with the electric igniter when the igniter is activated with electrical energy, the arrangement comprising:

the electric igniter which is introduced into a case of the ammunition unit located in the barrel body; and an internally located electrically insulating material in the form of a ceramic insert which prevents the electrical energy transmission from the electric igniter to the barrel body when firing takes place, wherein the insulating material is located along the length of the case and extends from beyond the back of the case to partially over a projectile assigned to the front of the case.

2. The arrangement according to claim 1, wherein the insert is arranged firmly shrunk into the barrel.

3. The arrangement according to claim 2, wherein the insert is clamped in with clamping of 300 MPa-1000 MPa, preferably 500 MPa-700 MPa.

4. The arrangement according to claim 2, wherein the insert comprises one or more ceramic material(s), preferably made from zirconium dioxide, aluminum oxide or silicon nitride.

5. The arrangement according to claim 1, wherein the insert is clamped in with clamping of 300 MPa-1000 MPa, preferably 500 MPa-700 MPa.

6. The arrangement according to claim 5, wherein the insert comprises one or more ceramic material(s), preferably made from zirconium dioxide, aluminum oxide or silicon nitride.

7. The arrangement according to claim 1, wherein the insert is arranged firmly bonded into the barrel.

8. The arrangement according to claim 7, wherein the insert comprises one or more ceramic material(s), preferably made from zirconium dioxide, aluminum oxide or silicon nitride.

9. The arrangement according to claim 1, wherein the insert is arranged firmly screwed into the barrel.

10. The arrangement according to claim 9, wherein the insert comprises one or more ceramic material (s), preferably made from zirconium dioxide, aluminum oxide or silicon nitride.

11. The arrangement according to claim 1, wherein the insert comprises one or more ceramic material(s), preferably made from zirconium dioxide, aluminum oxide or silicon nitride.

12. The arrangement according to claim 1, wherein the insert has a straight outer surface and an inner surface which follows the outer surface of an ammunition case.

13. The arrangement according to claim 1, wherein the insert is adapted to prevent energy transmission even at high voltage values, said high voltage values being in a range of 10-12 kV.

14. The arrangement according to claim 1, wherein the insert is adapted in order to make firing of an ammunition unit possible.

15. The arrangement according to claim 1, wherein the insert has an average thickness of 5-15 mm, preferably approximately 10 mm, depending on the caliber of the barrel.

16. The arrangement according to claim 1, wherein the insert is arranged in the barrel of an electrothermal/electrothermochemical weapon.

17. An arrangement for preventing electrical energy transmission from an electric igniter to a barrel body on firing of an ammunition unit which can be initiated with the electric igniter when the igniter is activated with electrical energy, the arrangement comprising:

the electric igniter which is introduced into a case of the ammunition unit located in the barrel body; and an internally located electrically insulating material in the form of a fibre-reinforced polymer insert which prevents the electrical energy transmission from the electric igniter to the barrel body when firing takes place, wherein the insulating material is located along the length of the case and extends from beyond the back of the case to partially over a projectile assigned to the front of the case.

18. An arrangement for preventing electrical energy transmission from an electric igniter to a barrel body on firing of an ammunition unit which can be initiated with the electric igniter when the igniter is activated with electrical energy, the arrangement comprising:

the electric igniter which is introduced into a case of the ammunition unit located in the barrel body; and an internally located electrically insulating material in the form of a fibre-reinforced polymer insert which prevents the electrical energy transmission from the electric igniter to the barrel body when firing takes place, wherein the insulating material is located along the length of the case and extends from beyond the back of the case to partially over a projectile assigned to the front of the case, wherein the insert is arranged by at least one of being firmly shrunk into the barrel, being clamped in with clamping of 300 MPa-1000 MPa, preferably 500 MPa-700 MPa or being firmly bonded into the barrel.

* * * * *